United States Patent [19]

McDavid

[11] 4,191,192

[45] Mar. 4, 1980

[54] ATHLETIC BRASSIERE

[76] Inventor: Robert F. McDavid, Box 921, Terre Haute, Ind. 47808

[21] Appl. No.: 25,346

[22] Filed: Mar. 30, 1979

[51] Int. Cl.[2] ..... A41C 3/08

[52] U.S. Cl. ..... 128/457

[58] Field of Search ..... 128/457, 430, 452, 517; 2/68

[56] References Cited

U.S. PATENT DOCUMENTS

| | | | |
|---|---|---|---|
| 2,364,899 | 12/1944 | Hatton | 128/452 |
| 3,740,765 | 6/1973 | Delplace | 2/67 |

*Primary Examiner*—Doris L. Troutman

*Attorney, Agent, or Firm*—D. Paul Weaver

[57] ABSTRACT

For athletic women, a brassiere formed of elasticized fabric includes a top stretch band which encircles the chest immediately below the armpits and above the breasts. Depending elongated breast cups extend from the chest band and have their lower terminals secured to elastic loops which encircle the upper legs. The breasts are independently depressed and restrained from movements relative to the general direction of body movement during exercising.

6 Claims, 5 Drawing Figures

FIG. 1
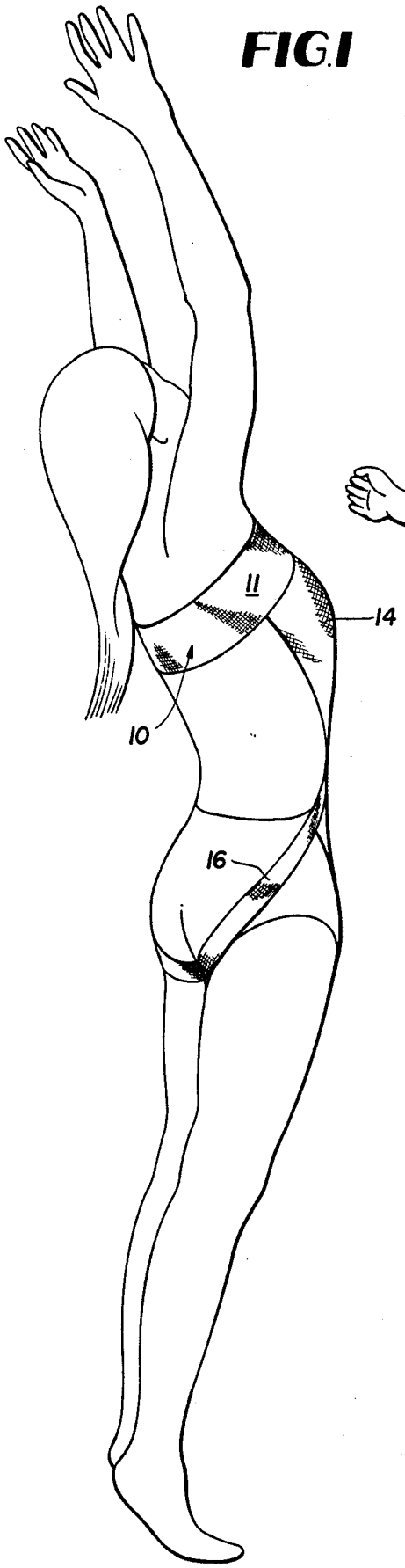
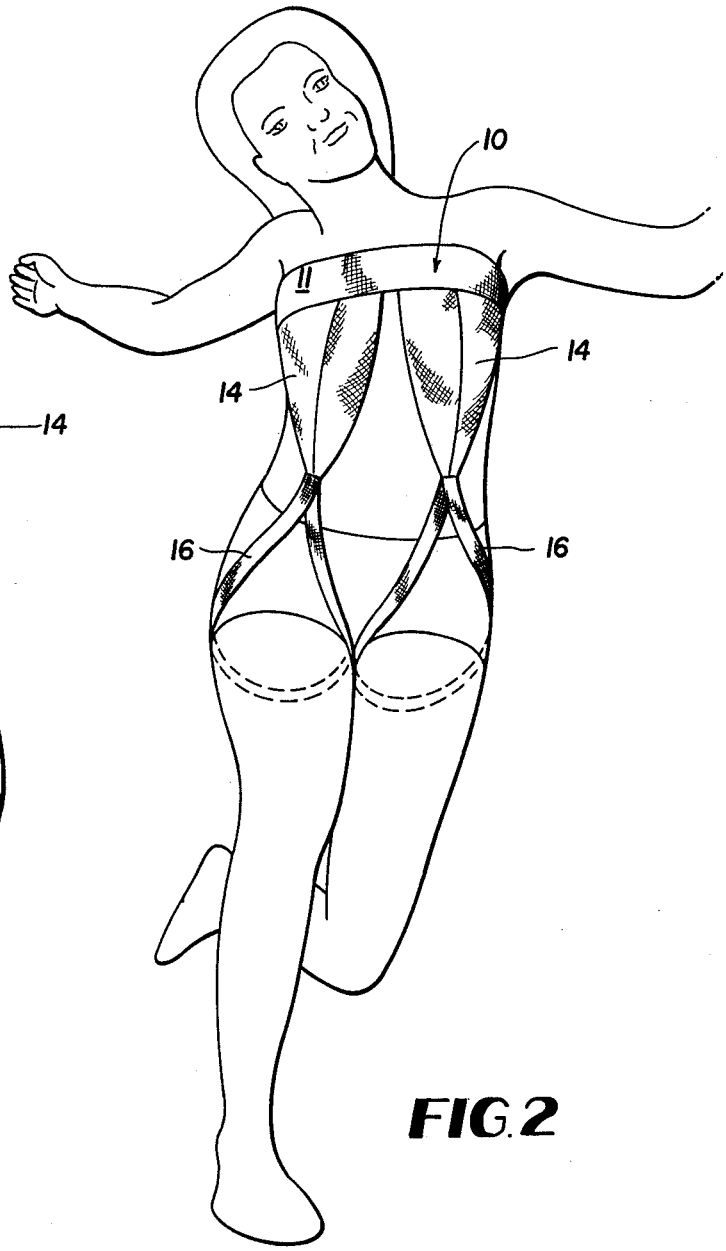
FIG. 2

ATHLETIC BRASSIERE

BACKGROUND OF THE INVENTION

The present invention seeks to provide an efficient and healthful brassiere for athletic women, such as joggers and those engaged in other sports activities.

The familiar bra is not appropriate for active women since it allows the breasts to move vertically and/or laterally with each fast movement of the body or jump. This in turn hinders the movement of the body forwardly, rearwardly or from side-to-side in athletic endeavors. Any movement of body parts that does not parallel the direction of total body movement is counter-productive and involves inertia which must be overcome. This makes the desired body movement more difficult. The unrestrained movement of the breasts during exercising is a prime example. Additionally, vigorous and abrupt movements of the breasts can cause bruising, pain and possibly serious internal tissue damage while reducing physical performance. By properly restricting breast movement, physical performance records should improve since total body movement can occur with less effort, producing less fatigue while conserving energy. Restriction of breast movement in women athletes will promote comfort, reduce pain and soreness, avoid internal damage, and eliminate psychological embarassment.

In the present invention, undesirable breast movement is substantially eliminated by flattening the breasts against the body and holding them down. This shortens their extension from the body and reduces their radii measured from the frontal plane to the breast center of mass. A shorter radius means less movement is possible. Further, in shortening the radius of the breasts, the body's center of mass is moved rearwardly and causes the total weight to be more evenly balanced over the weight-bearing bones. This improved balance provides for more efficient body movement and control.

While the prior patented art contains many teachings relative to the construction of brassieres, no known prior art device appears suitable for the purposes of this invention as above discussed. The following known prior art patents of general interest are made of record herein under 37 C.F.R. 1.56:

| | |
|---|---|
| 1,196,291 | 1,551,575 |
| 1,532,250 | 1,955,523 |
| 1,535,838 | 2,388,757. |

Other features and advantages of the invention will become apparent during the course of the following description.

BRIEF DESCRIPTION OF THE DRAWINGS

FIG. 1 is a rear and side perspective view of the invention during use.

FIG. 2 is a front perspective view of the invention.

DETAILED DESCRIPTION

Figure 4:
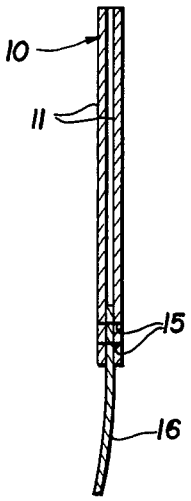
FIG. 4 is an enlarged fragmentary vertical section taken on line 4—4 of FIG. 3.

Referring to the drawings in detail wherein like numerals designate like parts, an athletic bra embodying the present invention comprises an elastic comparatively wide chest encircling band 10 which, in a preferred embodiment, may measure about 2¾" in width. The chest band 10 preferably comprises two thicknesses 11 of elasticized fabric, FIG. 4, joined at intervals around the band by vertical lines of stitching 12. The chest band is sized to embrace the chest snugly under the armpits and immediately above the breasts 13. Dependingly attached to the chest band 10 at the front thereof in laterally spaced relation are two downwardly tapering elongated breast cups 14 formed of suitable stretch fabric. The top edges of the cups 14 preferably engage between the two layers 11, FIG. 4, at the bottom edge portion of the band 10 and are anchored by suitable stitching 15.

At the bottom of each tapered breast cup 14, a comparatively narrow closed elastic loop or strap 16 is attached by stitching 17 and these straps are preferably formed of elasticized fabric or tape and, in a practical form, may measure about 1¼" in width. As shown in FIGS. 1 and 2, the two closed loop straps 16 encircle the upper thighs of the wearer, passing around the rear of the thighs close to the crotch region and then extending upwardly at the front of the body to an elevation somewhat above the waist.

Figure 3:
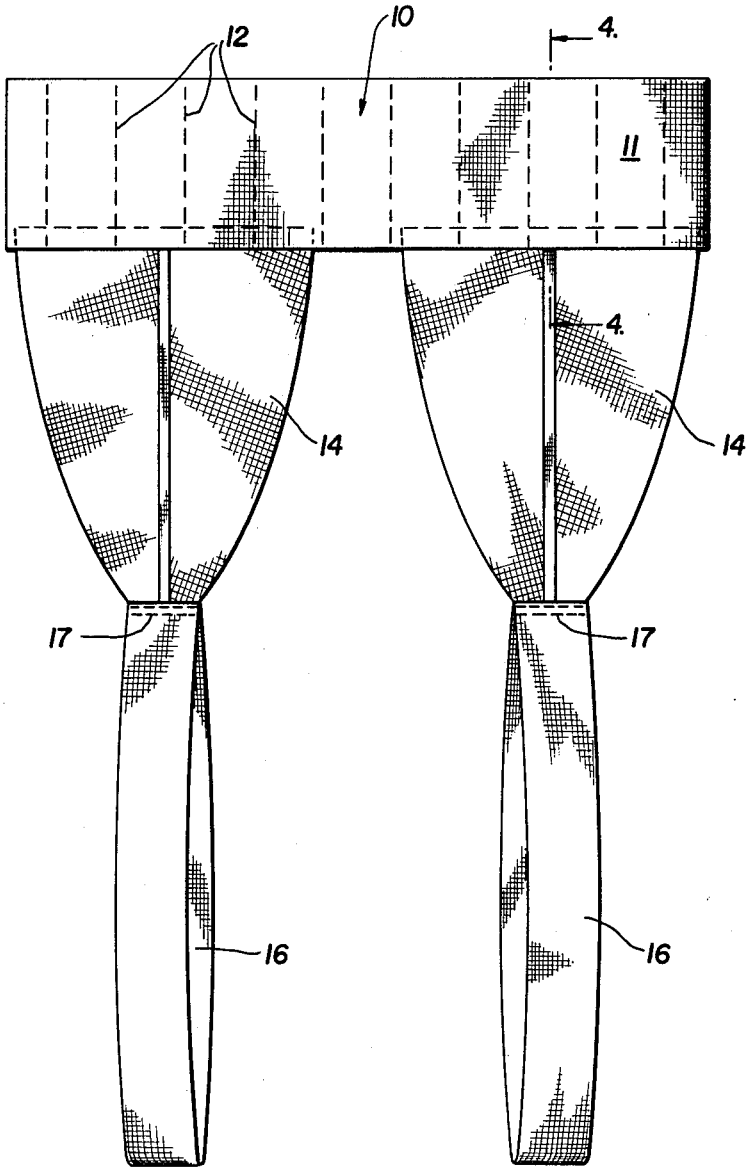
FIG. 3 is a front elevational view of the invention in a relaxed state.
Figure 5:
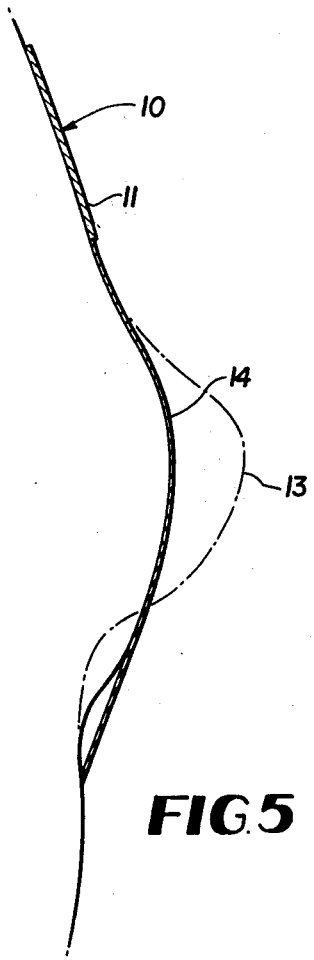
FIG. 5 is a partly diagrammatic view in vertical cross section showing the action of the brassiere in depressing the breasts and reducing protuberance from the body.

The brassiere or garment is unitary in construction and elastic. It is donned by stepping into the leg straps 16 and then pulling the chest strap 10 and elongated cups 14 upwardly into place with the chest strap under the armpits and above the breasts. When properly donned, the elasticity of the garment serves to depress the breasts against the body while holding the breasts down against displacement with a unique independent holding action for each breast. The diagrammatic showing in FIG. 5 illustrates how the normal breast curvature and protrusion is flattened out and maintained while the garment is worn. Any upward movement of the breasts during exercising is resisted by the downward pulling force of the leg straps 16 and the strong upward holding action of the wide elastic chest band 10. The band 10 resists being pulled down by the leg straps or other forces because the circumference of the body trunk at armpit level is slightly smaller than at points immediately therebelow.

The depression and restraining of the breasts is made possible by a unique interaction between the parts of the bra and the anatomical parts with which it is engaged.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An athletic brassiere comprising an elastic chest band adapted to snugly encircle the chest of a wearer near the armpits and above the breasts, a pair of breast cups secured to the frontal portion of said chest band, and a pair of elastic straps attached to said cups and adapted to encicle the legs of a wearer of the brassiere and exerting a downward pull on the cups which is resisted by the holding action of said chest band.

2. An athletic brassiere as defined in claim 1, and said chest band being a comparatively wide band in the range of at least two to three inches to enable the necessary resistance to downward displacement of the chest band.

3. An athletic brassiere as defined in claim 1, and said breast cups being elongated and downwardly tapered with their top edge portions attached to a lower edge portion of said chest band in laterally spaced relationship.

4. An athletic brassiere as defined in claim 1, and said elastic straps comprising closed loop straps each attached to the lower end portion of one of said cups.

5. An athletic brassiere as defined in claim 4, and said elastic straps being flexible and highly stretchable and being narrow in comparison to the width of said chest band and having a width in the range of 1"–1½".

6. An athletic brassiere as defined in claim 2, and said chest band comprising two superposed layers of elasticized fabric which is stretchable at least circumferentially in terms of the body of a wearer of the brassiere.

* * * * *